US008647133B2

(12) United States Patent
Saur

(10) Patent No.: US 8,647,133 B2
(45) Date of Patent: Feb. 11, 2014

(54) ELECTRICAL PLUG CONNECTION

(75) Inventor: Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 161 days.

(21) Appl. No.: 12/998,539

(22) PCT Filed: Oct. 13, 2009

(86) PCT No.: PCT/EP2009/063323
§ 371 (c)(1),
(2), (4) Date: Jul. 14, 2011

(87) PCT Pub. No.: WO2010/060679
PCT Pub. Date: Jun. 3, 2010

(65) Prior Publication Data

US 2011/0263143 A1 Oct. 27, 2011

(30) Foreign Application Priority Data

Nov. 3, 2008 (DE) ..... 10 2008 043 404

(51) Int. Cl.
*H01R 13/62* (2006.01)

(52) U.S. Cl.
USPC ..... 439/299; 439/540.1

(58) Field of Classification Search
USPC ..... 439/299, 300, 540.1, 924.2
See application file for complete search history.

(56) References Cited

U.S. PATENT DOCUMENTS

| | | | | |
|---|---|---|---|---|
| 4,743,207 | A | 5/1988 | Clark | |
| 5,326,279 | A * | 7/1994 | Sumida | 439/540.1 |
| 5,773,763 | A * | 6/1998 | Stachulla | 174/135 |
| 6,053,756 | A | 4/2000 | Flanigan et al. | |
| 7,278,879 | B2 * | 10/2007 | Kim et al. | 439/540.1 |
| 7,404,735 | B2 * | 7/2008 | Reker et al. | 439/540.1 |

FOREIGN PATENT DOCUMENTS

| | | |
|---|---|---|
| EP | 0 626 737 | 11/1994 |
| FR | 2 886 065 | 11/2006 |
| JP | 11-40279 | 2/1999 |
| JP | 2002-75542 | 3/2002 |
| JP | 2002-514000 | 5/2002 |
| JP | 2005-285512 | 10/2005 |
| WO | WO 2007/003803 | 1/2007 |

* cited by examiner

*Primary Examiner* — Hien Vu
(74) *Attorney, Agent, or Firm* — Kenyon & Kenyon LLP

(57) ABSTRACT

In an electrical plug device, which has at least one projection which projects at least regionally in the radial direction and is developed along at least a portion of the periphery, at least parts of the at least one projection have an asymmetrical design.

9 Claims, 6 Drawing Sheets

ELECTRICAL PLUG CONNECTION

BACKGROUND OF THE INVENTION

1. Field of the Invention

The present invention relates to an electrical plug connection which has at least one projection projecting at least regionally in the radial direction and is formed along at least a portion of the circumference. Furthermore, the present invention relates to a plug connection system which includes a plurality of electrical sockets and a plurality of electrical plug devices. In addition, the present invention relates to an electrical control device system having at least one electrical plug device and/or at least one plug connection system.

2. Description of Related Art

Electrical plug devices are frequently used in the manufacture of motor vehicles. In particular when higher electrical outputs, higher electrical current intensities and/or higher electrical voltages are used, sufficient shock-hazard protection and/or the safeguarding or checking of a safe plug state are/is required.

Plug boards known from the related art are frequently equipped with locking slides. These locking slides have projections which regionally engage with the plug connector from behind and thereby provide a secure seat of the plug connector. One disadvantage of such plug boards is the relatively complex design and the time-consuming assembly of the plugs on the plug board.

BRIEF SUMMARY OF THE INVENTION

Therefore, an electric plug device is provided, which has at least one projection that projects at least regionally in the radial direction and is formed along at least a portion of the circumference, such that at least portions of the at least one projection have an asymmetrical design. The asymmetrical design makes it surprisingly easy for the electric plug devices to support each other or to lock each other, or for them to be mounted or locked into place on holding devices in an uncomplicated manner. Furthermore, the provided asymmetrical design of the projection also makes it possible to provide the plug devices with a specific code, so that the plug devices may be plugged in (only) at suitable locations and set up only in a certain sequence. The electrical plug devices themselves may have various symmetrical or asymmetrical designs. For example, a circular, oval, rectangular, square, triangular or similar shape of the device is conceivable. The electrical plug devices may have a single electrical contact or also a multitude of electrical contacts (e.g., 2, 3, 4, 5 or 6 contacts), as desired. The electrical plug devices are configurable both for small currents (e.g., for electrical signal lines, measuring signal lines, control current lines, computer signal lines and the like), or they may be configured for high currents or outputs (e.g., for the connection of electrical motors, electrical generators, accumulators etc.).

In an advantageous manner, the electrical plug devices have a plurality of projections, projection pairings preferably being provided, which essentially are positioned diametrically to each other and/or at an angle with respect to each other. The provided design in particular allows the electrical plug devices to mutually support or lock each other when positioned in a row or in some other manner one after the other. Such plug strips disposed along one direction are widely used, especially in the construction of vehicles, since this design makes it particularly easy to place the sockets along a board for electronic components. In addition to a row running in the longitudinal direction, it is specifically also possible to provide a zigzag row or an arc of electrical plug devices disposed one after the other. This type of placement of the electrical plug devices with respect to each other may be based on the space specifications, in particular.

It may be advantageous if at least two projections and/or at least to projecting areas are situated at a mutual offset in the axial direction. Such a design often makes it possible to realize mutual locking of a plurality of electrical plug devices in an especially uncomplicated manner. It may also be advantageous, in particular, if a plurality of electrical plug devices has an identical design (at least in terms of their basic structure). This may allow simplifications in the production, in particular, and/or in the stock-keeping of the electrical plug devices or their pre-construction stages. In this connection it should be pointed out that an unambiguous assignment of an electrical plug device to a corresponding socket is frequently able to be made anyway, based on the special design of the electrical plug contact itself.

It may also be useful if at least two projections and/or at least two projecting areas are provided with at least one fitting element. This makes is especially easy to realize mechanical coding of the electrical plug devices, so that they are able to be affixed only in the specially provided socket, for example, and/or to be positioned only in a specific allowed sequence relative to each other.

One useful specific development of at least one fitting element may result if it is designed in the form of a recess and/or a projection, the fitting element being aligned in the radial and/or axial direction at least regionally. Various geometric forms may be considered in this context, which, for instance, are implemented in the form of lip-type projections and/or corresponding recesses. For example, circular, triangular, rectangular, square, pentagonal etc. forms are conceivable here. Also, a corresponding placement (such as a lengthwise placement) of projections and/or recesses may be considered, the projections and/or recesses being formed in such a way that an unambiguous fit may result. For example, projecting pins could be provided at 2, 3, 4 or 5 conceivable coding points, using different placements and/or numbers. Corresponding recesses may then be provided on the opposite side. It is possible, in particular, to dispose the corresponding fitting elements in the axial direction. In this case they usually project from a plane formed by the projection of the electrical plug device. Another option is to provide the corresponding fitting elements in the radial direction, with the result that the corresponding elements usually may be situated on the outside of the corresponding projection of the electrical plug device.

It is usually advantageous if the electrical plug device is provided with at least one anti-rotation element. This makes it possible to secure the electrical plug device in place in a definite position (or possibly in multiple definite positions) relative to a corresponding socket, or it makes it possible for the electrical plug device to be plugged into the electrical socket in only one (or several) defined position(s). In most cases this achieves a better mechanical seat of the electrical plug device and, in particular, it is frequently possible to realize the method of functioning of the projection (i.e., the mutual locking of a plurality of electrical plug devices, in particular) in a more defined, reliable and stable manner. This is true especially when fitting elements are provided.

One particularly meaningful development may result if the electrical plug device has at least one projection, which forms part, preferably an integral part, especially preferred, an integral part of an electrical shock-hazard protection, for the electrical plug device. This makes it possible to realize an especially strong and stable seat of the projection. Furthermore, the production, the positioning and the manageability of the electrical plug device (especially when mounting the electrical plug device in a socket) is frequently able to be improved. In particular when at least one projection is integrally developed with an electrical shock-hazard protection, the corresponding part of the electrical plug device may be produced using a plastic injection-molding process, which frequently is especially cost-effective.

Furthermore, a plug connection system is provided, which has a plurality of electrical plug sockets as well as a plurality of electrical plug devices, at least one electrical plug device having the structure of the previously described design. The plug connector system then analogously has the characteristics and offers the advantages already described in connection with the electrical plug device.

It may be advantageous, in particular, if at least one part of the electrical plug device of the plug connector system is mechanically self-locking, at least partially. This provides for an especially firm seat of the electrical plug device(s) in the sockets. Furthermore, unplugging of individual electrical plug devices is able to be prevented, this relating in particular to electrical plug devices that lie on the inside. Another option is, in particular, that the existence of an electrical contact of all plug device system is realizable in an especially uncomplicated manner using a single "control authority", i.e., especially when the corresponding "control instance" is located at a suitable end of an electrical plug device system. Incidentally, it is also possible to provide for at least one projection of at least one electrical plug connection a corresponding device in connection with at least one electrical socket, which device supports the plug connection in the electrical socket.

One useful further development results if at least one plug-in signaling device is provided, which is developed as switch device and/or as signal-line plug device, in particular. For example, an interrupter head of a switch device may make mechanical contact with a projection of an electrical plug device. The switch device closes only if the corresponding electrical plug device is safely seated in the corresponding socket in electrical and mechanical terms. Making use of the switch device, it is therefore possible to verify a mechanically firm seat of the corresponding electrical plug device via a corresponding control logic. Via a possibly existing mechanical blockade of the electrical plug devices among each other, this also makes it possible to verify an electrically and/or mechanically secure affixation of at least a portion of the other electrical plug devices. Instead of a switch device, it is also possible, for example, to implement a signal-line plug device at the extremity. If the electrical contact is interrupted by the corresponding signal-line plug device, then this usually is a reliable indication that the corresponding plug device has been unplugged from the socket. The signal-line plug device may have a single electrical conductor if desired, or preferably it may have additional electrical signal lines via which corresponding information is transmittable. For example, the signal-line plug device may be implemented in the form of an electrical multi-contact plug such as a multipoint plug strip, or as a flat-pin plug multipoint connector strip known from computer design.

Furthermore, an electrical control device system is provided, in particular an electrical control device system for controlling at least one electric motor in electrically operated vehicles and/or hybrid vehicles, in which at least one electrical plug device according to the previous description is provided, and/or at least one plug connector system according to the previous description is provided. The electrical control device system then offers the already described advantages and characteristics in analogous manner. The electrical control device system may be power electronics, in particular. These power electronics, in particular, may be provided with corresponding cooling means for dissipating the heat that is generated in the process. It is also possible, in particular, to use the fluid circulation for the cooling. Especially in the case of hybrid vehicles, the coolant recirculation of the hybrid vehicle may be utilized for this purpose, which is usually provided anyway. With the aid of coolant recirculation, in particular, high heat outputs are able to be dissipated in a reliable manner.

Finally, a method for setting up electrical plug devices in electrical sockets is provided in addition, in particular in an electrical control device system, preferably an electrical control device system for controlling at least one electric motor in electrically driven vehicles and/or hybrid vehicles, in which at least one first electrical plug device mechanically locks at least one second electrical plug device at least partially. In analogous manner, the method provided here likewise has the characteristics and advantages already been described in connection with the electrical plug devices, the plug connector system and the electrical control device system.

Of course, it is also possible to further develop the provided method within the meaning of the above description.

DETAILED DESCRIPTION OF THE INVENTION

Figure 1:
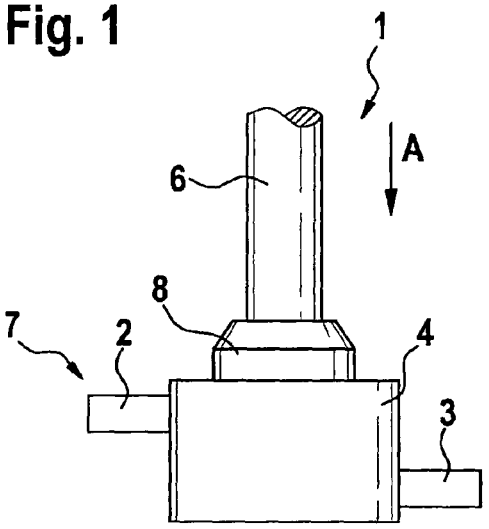
FIG. 1 shows a first exemplary embodiment of a plug, viewed from the side.
Figure 2:
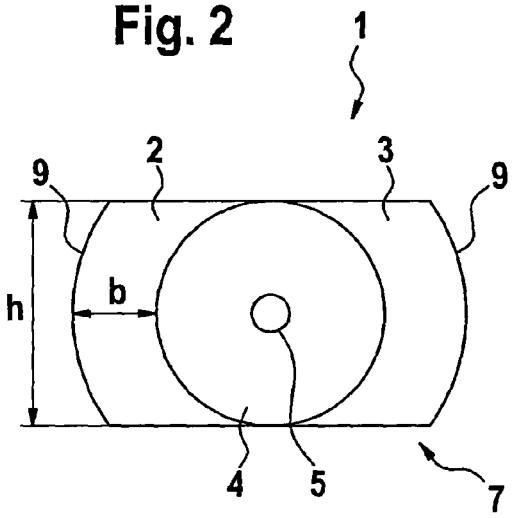
FIG. 2 shows the plug shown in FIG. 1 in a view from below.

FIG. 1 schematically shows a first exemplary embodiment of an electrical plug 1 in a side view, which plug has two projections 2, 3 disposed asymmetrically with respect to each other. FIG. 2 shows electrical plug 1 shown in FIG. 1 in a schematized view from below.

In the present exemplary embodiment, projections 2, 3 are integrally premolded on the side of a shock-hazard protection 4. Projections 2, 3 and shock-hazard protection 4 are made from the same material. For example, projections 2, 3 and shock-hazard protection 4 may be produced from a plastic material, and a plastic injection molding process is able to be used for the shaping.

Shock-hazard protection 4 surrounds an electrical plug connector 5 disposed inside shock-hazard protection 4 in centered manner. As shown here, electrical plug connector 5 may be designed as round plug connector. However, electrical plug connector 5 is also implementable as flat-pin plug connector or in some other manner. Naturally, there is also the option of providing a plurality of electrical plug connectors 5, such as 2, 3, 4, 5, 6 or 7 electrical plug connectors, for instance. Electrical plug connector 5 is in electrical contact with a cable 6, which leads away from shock-hazard protection 4 in an axial direction A. In the exemplary embodiment shown, cable 6 is surrounded by an electrical insulation protection. As an alternative, it is naturally also possible to lead cable 6 of electrical plug 1 away from plug area 7 at an angle relative to axial direction A, such as an angle of 90°, for example. A baffle, which is known per se, may be used for this purpose. In particular in the latter case, axial direction A then frequently relates to the position of electrical plug connector 5 in plug area 7, in other words: the direction in which electrical plug 1 must be moved in order to be plugged into a suitably developed socket.

In the exemplary embodiment shown, however, cable 6 is connected to plug area 7 in axial direction A. In addition, FIG. 1 shows a cord grip 8 between cable 6 and shock-hazard protection 4, which provides secure and durable support of cable 6 on plug area 7. Parts of cord grip 8 may additionally act as mechanical mount fixture of electrical plug connector 5.

In the exemplary embodiment of electrical plug 1 shown in FIGS. 1 and 2, the two projections 2, 3 on shock-hazard protection 4 are disposed at a mutual offset in axial direction A. However, as can be gathered from FIG. 2, in particular, projections 2, 3 have an identical design in all other respects. Projections 2 and 3 are situated on shock-hazard protection 4 in such a way that they project from plug area 7 in directions that are diametrically opposed. Width b of projections 2, 3 is usually selected in a range from 5 mm to 10 mm. Such a width b is relatively compact on the one hand, yet allows projections 2, 3 to absorb sufficient mechanical force on the other; moreover, they are able to compensate for bearing tolerances of two adjacently disposed electrical plugs 1 (cf. FIGS. 9, 10, for example) to a sufficient extent. Length L of projections 2, 3 roughly corresponds to the diameter of shock-hazard protection 4 which surrounds electrical plug connector 5. In this way, a plurality of electrical plugs 1 may be placed in a row, one after the other, without unnecessarily increasing the width of the ultimately formed row of plugs.

Of course, it is possible to use other dimensions as well, especially for particular designs. For example, width b of projections 2, 3 may be less than 5 mm if plugs 1 are relatively small. Conversely, in the case of power connectors 1, which have a correspondingly large size, the width of projections 2, 3 may certainly also be selected greater than 10 mm.

In the exemplary embodiment shown, outer contour 9 of projections 2, 3 furthermore is selected such that a convex outer contour 9 of plug area 7 of electrical plug 1 is produced. The external region of projections 2, 3 extends virtually parallel to the outer contour of shock-hazard protection 4. However, it is also possible, for example, that projections 2, 3 form a rectangular outer contour 9. It is likewise possible for outer contour 9 of projections 2, 3 to have a concave form (cf. FIGS. 11, 12, for example). In this way projections 2, 3 may simultaneously act as anti-rotation elements for electrical plug 1. One advantage of convex outer contour 9 is that it is relatively compact and saves material. Furthermore, rounded outer contour 9 provides a lower risk of injury or damage when mounting electrical plug 1. Selected convex outer contour 9 is also relatively tolerant with regard to misalignments.

Figure 11:
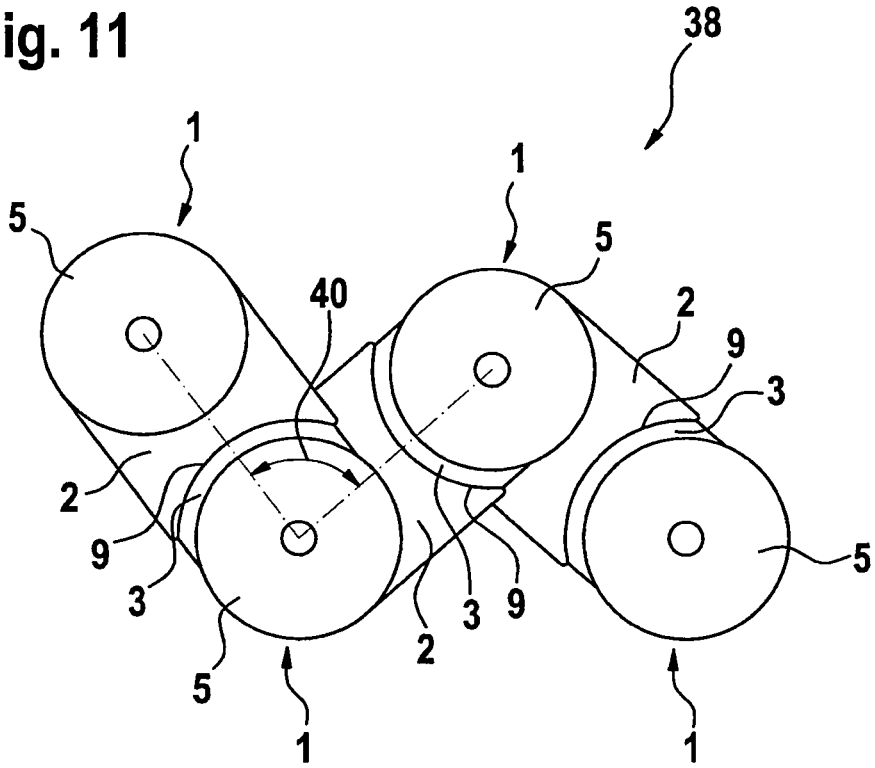
FIG. 11 shows one potential exemplary embodiment of the placement of multiple plugs.
Figure 12:
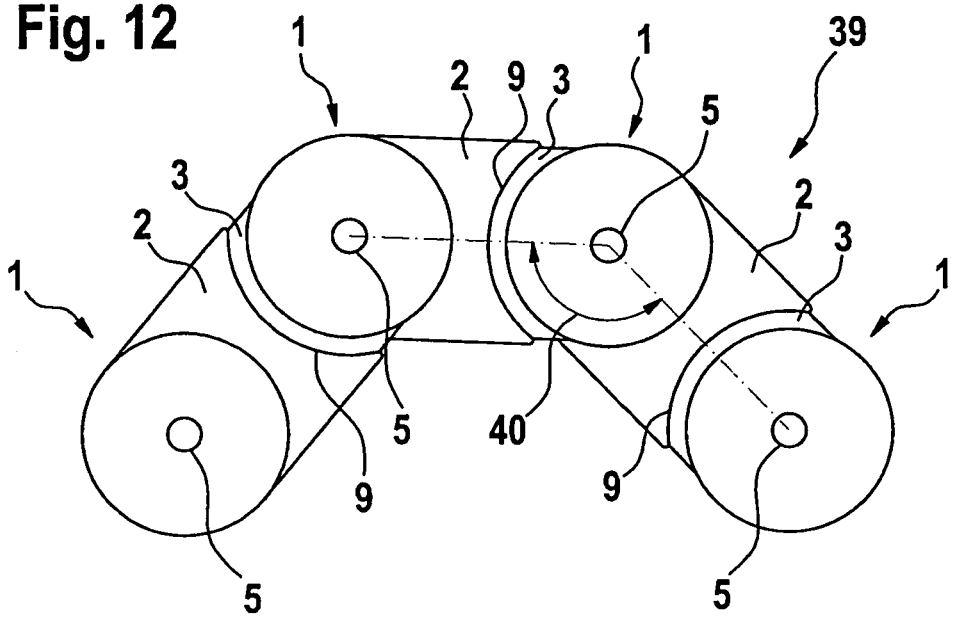
FIG. 12 shows an additional potential exemplary embodiment of the placement of multiple plugs.

In addition to the placement of individual electrical plugs 1 in a row, one after the other (cf., for example, FIGS. 9, 10), it is also possible, for example, to place individual electrical plugs 1 in a zigzag row 38 (cf. FIG. 11), or along an arc 39 (cf. FIG. 12).

In order to form zigzag row 38 shown in FIG. 11, for instance, projections 2, 3 of individual electrical plugs 1 are situated at an angle $\alpha_1$ 40 relative to each other. In the exemplary embodiment shown here, angle $\alpha_1$=90° (the direction of angle $\alpha_1$ varying in each case).

In contrast, in the exemplary embodiment shown in FIG. 12, individual electrical plugs 1 are disposed along an arc 39. Here, too, projections 2, 3 of individual electrical plugs 1 are disposed at an angle $\alpha_2$ 40 with respect to each other. However, the size of angle $\alpha_2$ 40 is different and amounts to $\alpha_2$=135° in the exemplary embodiment shown in FIG. 12. Of course, the size of the angle depends on the radius of arc-type placement 39 of individual electrical plugs 1, in particular.

Figure 3:
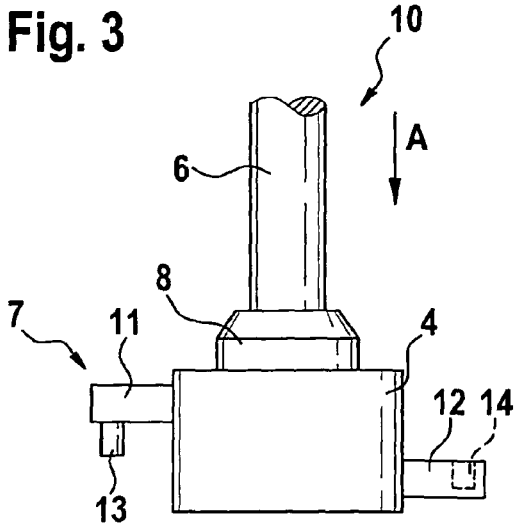
FIG. 3 shows a second exemplary embodiment of a plug, viewed from the side.
Figure 4A:
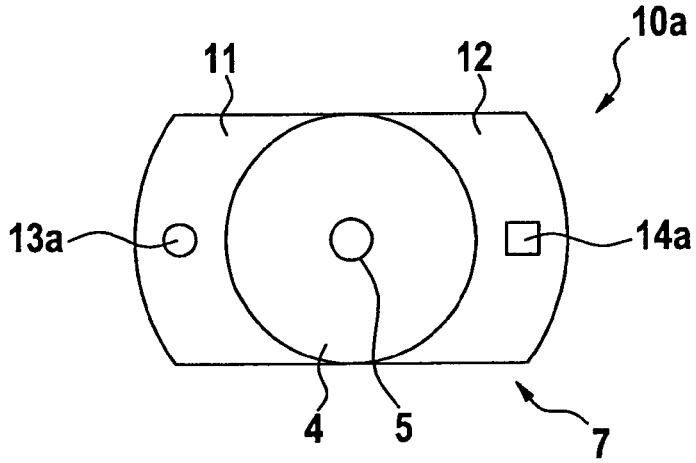
FIG. 4 shows different design options for the plug shown in FIG. 3, viewed from below.

FIG. 3 and FIG. 4 show an additional exemplary embodiment of an electrical plug 10. FIG. 3 shows electrical plug 10 in a schematized side view. In contrast, FIG. 4 shows electrical plug 10 in a schematized view from below. FIG. 4, FIG. 4*a*; 4*b*, 4*c* illustrate different possibilities of developing axially aligned fitting elements (projection 13 and receiving opening 14).

Figure 4B:
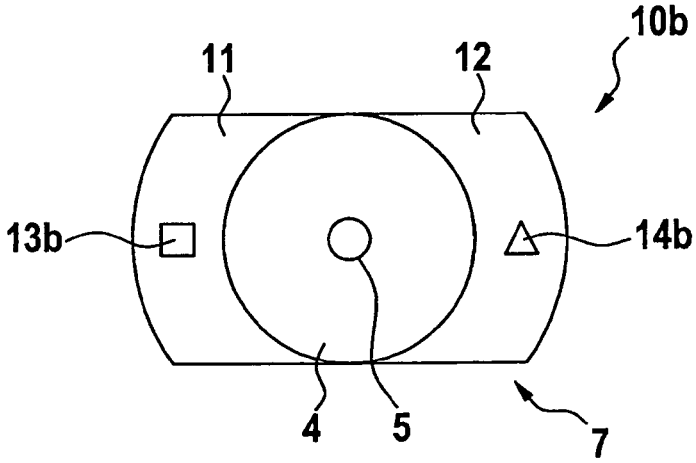
Figure 4C:
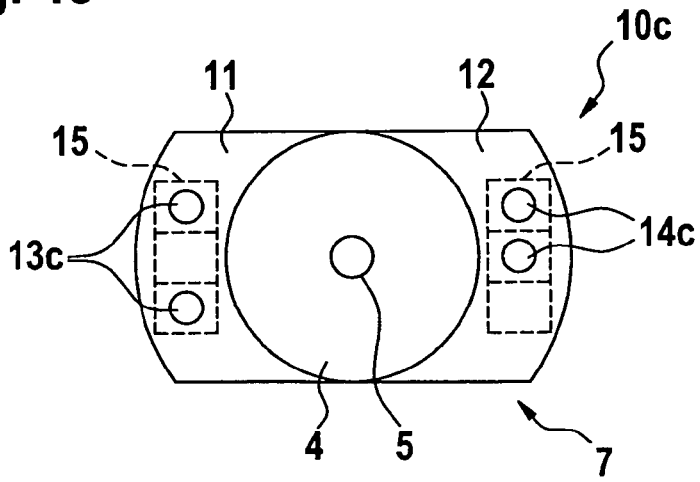

Electrical plug 10 shown in FIGS. 3 and 4 largely resembles electrical plug 1 shown in FIGS. 1 and 2. In contrast, however, a projecting pin 13 (or a plurality of projecting pins 13*c*; cf. FIG. 4*c*) and/or a receiving opening 14 (or a plurality of receiving openings 14*c*, cf. FIG. 4*c*) is/are provided at projections 11, 12 in addition, which is/are premolded on shock-hazard protection 4 of plug part 7 of electrical plug 10. Projecting pins 13 as well as receiving openings 14 are situated on sides of projections 11, 12 facing each other. This is true in particular in cases in which a receiving opening 14 is developed as blind hole. However, it is also possible to develop one or more of receiving opening (s) 14 as traversing bore holes. As a rule, however, it is irrelevant at which projection 11, 12 projecting pin 13 or receiving opening 14 is provided. That is to say, projecting pin 13 may be provided not only at projection 11 facing away from the plug-in area—as illustrated in FIG. 3—, but just as well at projection 12 facing the plug-in area. Receiving opening 14 will then be provided in the respective other projection 11, 12.

In FIG. 4, different possibilities for developing aforementioned pins 13 or receiving openings 14 are shown by way of example in sub-FIGS. 4*a*, 4*b*, 4*c*.

In FIG. 4*a*, for example, projecting pin 13*a* situated on first projection 11 in approximately centered manner has a circular cross-section. In contrast, receiving opening 14*a*, which is formed in second projection 12 of electrical plug 10*a* shown in FIG. 4*a*, has a square cross-section. Due to the different forms of cross-sections of projecting pin 13*a* and receiving opening 14*a*, two electrical plugs 10*a* that have the same design (that is to say, two electrical pins according to FIG. 4*a*, for example) are unable to be "contacted" by each other (cf. FIGS. 9, 10). In this way it is effectively prevented that a plurality of electrical plugs 10*a* are plugged into a corresponding multipoint connector strip in the wrong sequence, for instance.

Of course it is also conceivable that projecting pin 13*a* and receiving opening 14*a* have an identical cross-section. In this case, corresponding electrical plugs 10*a* may be contacted with each other in random manner. If required and/or desired, the exchange safety may then be realized in different manners, for example by using differently formed electrical plug connectors 5 and/or by using a different number and/or position of electrical plug connectors 5. Nevertheless, by providing projecting pins 13 and/or receiving openings 14, an anti-rotation lock and/or a particularly firm mechanical connection are/is able to be realized in an advantageous manner.

FIG. 4*b* shows a design which is very similar to the design in FIG. 4*a*. Only the forms of the cross-sections of projecting pin 13*b* and receiving opening 14*b* have a design that deviates from the example shown in FIG. 4*a*. For instance, projecting pin 13*b* of electrical plug 10*b* shown in FIG. 4*b* has a square cross-section, whereas receiving opening 14*b* has a triangular cross-section.

Because of the mutually corresponding design of projecting pin 13*b* of electrical plug 10*b* shown in FIG. 4*b* and of receiving opening 14*a* of electrical plug 10*a* shown in FIG. 4*a*, both electrical plugs 10*a*, 10*b* are able to be brought into contact with each other. A plug system 10*a*-10*b* thus is a reliable plug system, whereas a plug system 10*b*-10*a*, for example, is not allowed.

FIG. 4*c* shows an encoding option, which is able to be used as an alternative or in addition to the encoding option shown in FIGS. 4*a*, 4*b*. In the case at hand, a plurality of areas 15 is provided in projections 11, 12 (shown in FIG. 4*c* by dashed lines), in which projecting pins 13*c* or receiving recesses 14*c* may be provided. By providing (or not providing) pins 13*c* or receiving recesses 14*c* accordingly, a specific plug sequence between electrical plugs 10*c* is able to be permitted or barred.

Figure 5:
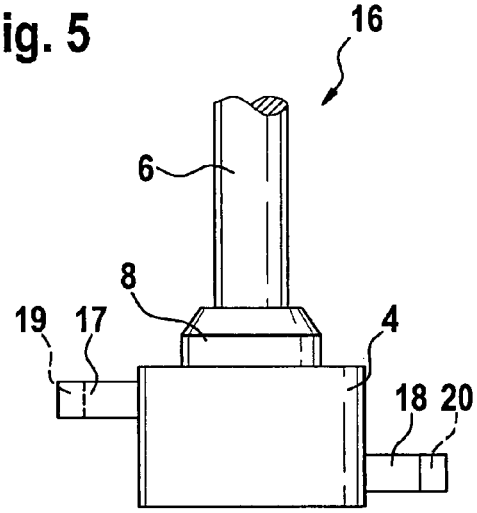
FIG. 5 shows a third exemplary embodiment of a plug, viewed from the side.
Figure 6:
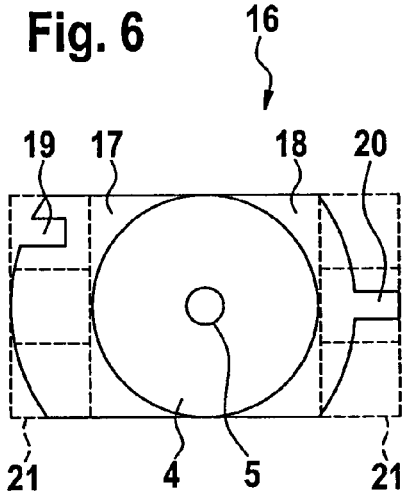
FIG. 6 shows the plug shown in FIG. 5 in a view from below.

In FIGS. 5, 6, a further potential design of an electrical plug 16 is shown. This, too, is similar to electrical plugs 1, 10 already described. In the illustrated exemplary embodiment of electrical plug 16 shown in FIGS. 5, 6, an edge toothing 19, 20 is provided in the region of projections 17, 18 in each case. Edge toothing 19, 20 has one or a plurality of projecting lips 20, and also one or a plurality of groove-type recesses 19. Analogous to the exemplary embodiment shown in FIG. 4*c*, a plurality of areas 21 is provided (indicated by a dashed line in FIG. 6), in which a groove-type recess 19 and a projecting lip 20 may be provided or omitted. By combining groove-type recesses 19 and projecting lips 20 accordingly, an accepted sequence of electrical plugs 16 is able to be allowed, or a forbidden sequence able to be prevented.

It should be mentioned that the provision of edge toothings 19 may naturally constitute not only an alternative but also an addition to the option shown in FIGS. 3 and 4, using projecting pins 13 or receiving recesses 14.

Figure 8:
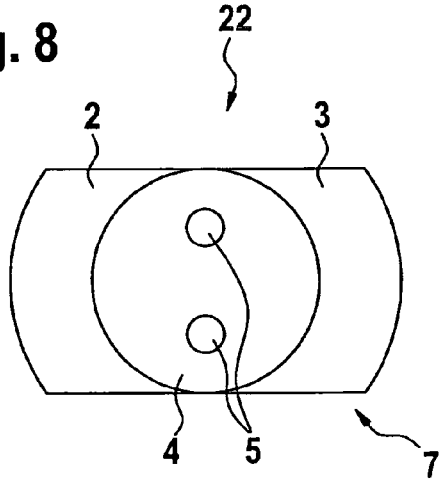
FIG. 8 shows an exemplary embodiment of a multipole plug, viewed from below.

FIG. 8 illustrates exemplarily that an electrical plug 22 may certainly also have a plurality of electrical plug connectors 5 within its shock hazard protection 4. In the exemplary embodiment shown in FIG. 8, two electrical plug connectors 5 each having a round cross-section are shown. As already mentioned, however, it is also possible to provide a different number of electrical plug connectors 5. Also, the geometry of plug connectors 5 may deviate from the exemplary embodiment shown in FIG. 8. Furthermore, the geometries of individual electrical plug connectors 5 may differ from each other at least partially.

Electrical plug 2 shown in FIG. 8 also has an anti-rotation element as a result of its electrical plug connectors 5. When electrical plug 22 is plugged in, it cannot be rotated. In the same way, electrical plug 22 is able to be plugged into in the socket region only in defined positions. However, given the geometry shown in FIG. 8, it is possible to plug electrical plug 22 into the corresponding socket part at a position that is rotated by 180°. This may also be prevented by, for example, an appropriate number, form and/or position of electrical plug connectors 5.

Figure 7:
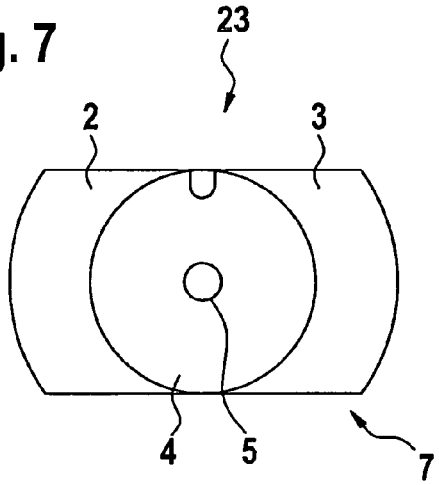
FIG. 7 shows an exemplary embodiment of a plug having an anti-rotation element, viewed from below.

In FIG. 7, a further electrical plug 23 is shown in a schematized view from below. This electrical plug 23, too, is similar to the already introduced electrical plugs 1, 10, 16, 22. However, in the region of its shock hazard protection 4, the electrical plug 23 shown here is provided with a mechanical anti-rotation element 24 in addition, which takes the form of a groove-type projection 24 on the inside of shock hazard protection 4. Anti-rotation element 24 produces not only a rotation lock of the plugged-in plug, but also ensures that electrical plug 23 is plugged into a corresponding socket area in the correct position.

Figure 9:
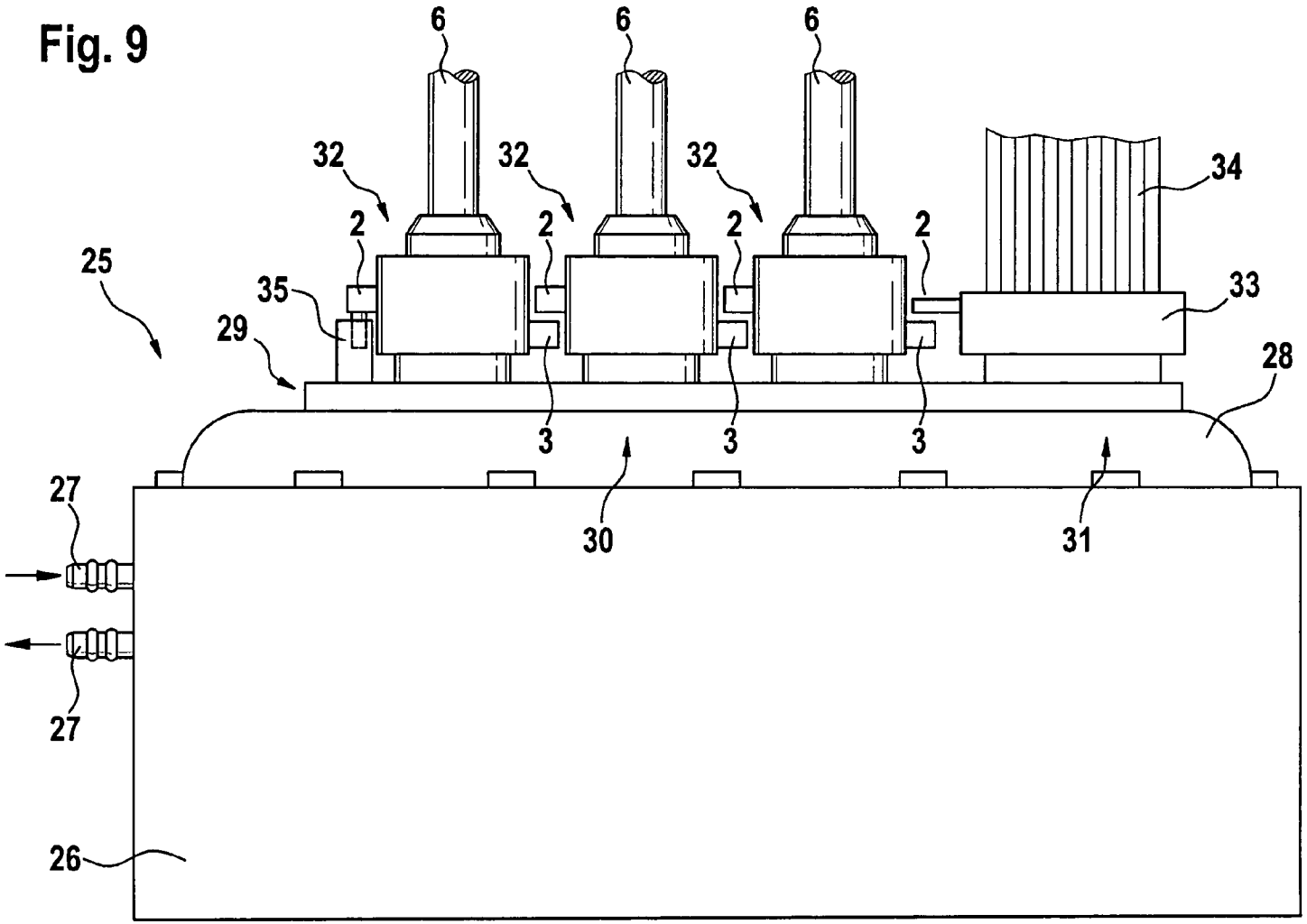
FIG. 9 shows a first exemplary embodiment of an electrical control device system having plugs mounted thereon.

FIG. 9 shows a first exemplary embodiment of an electrical control device 25 in a schematized plan view from the side. Electrical control device 25 has a housing 26 in which an electronic control circuit is accommodated, for example, which controls the electric motor or controls the electrical generator in case of a hybrid vehicle (depending on the state of the driving operation). The electronic control circuit is provided with appropriate power semiconductors for that purpose. The power semiconductors generate a certain waste heat in the course of the control circuit's operation, which is dissipated via the coolant circulation of the hybrid vehicle in the present exemplary embodiment. Coolant connections 27, which are provided on electronic control device 25, are used for this purpose.

An electrical contact strip 29 is provided on lid 28 of electronic control device 25. Electrical contact strip 29 has a power plug region 30, where a plurality of electrical power plugs 32 is plugged in. Furthermore, electrical contact strip 29 has a control plug region 31, where electrical control lines, electrical signal lines etc. are routed to electrical control device 25. In the exemplary embodiment of electrical control device 25 shown in FIG. 9, a flat plug 33, whose basic configuration is similar to known flat plugs used in the computer field, for example, are used for that purpose.

Electrical power plugs 32 are provided with two projections 2, 3 in each case. Flat plug 33 also has a projection (but only a single projection 2 in the case at hand).

The position, placement and form of projections 2, 3 or of electrical power plugs 32 as well as flat plug 33 may be implemented according to the design options illustrated in FIG. 1 through 8.

When electrical power plug 32 as well as flat plug 33 are plugged in, a first projection 2 engages behind corresponding second projection 3 of adjacent electrical plug 32, 33, as can be gathered from FIG. 9. Thus, in the exemplary embodiment shown in FIG. 9 it is impossible to unplug one of electrical power plugs 32 without detaching flat plug 33 in the process. However, a line designed as control line is provided in flat cable 34 of flat plug 33, such that electronic power plugs 32 and/or power plug contacts 30 of electric contact strip 29 are switched by suitable control electronics to be without voltage if the control line is interrupted. This makes it possible to realize a very high contact safety using very simple means. If projections 2, 3 additionally include "encoding" analogous to the exemplary embodiments of the electrical plug in FIG. 3 through 6, it is furthermore possible to ensure a correct sequence of electrical power plugs 32 when plugging them into electrical control device 25. In particular, it is also possible to provide a terminal projection 35 on lid 28 or on electrical contact strip 29, which includes a suitable receiving opening 14 (cf. FIGS. 3, 4). It is also possible to design terminal projection 35 in such a way that it is able to cooperate with an edge toothing 19, 20 according to the exemplary embodiment of an electrical plug 16 shown in FIGS. 5, 6. With the aid of such a terminal projection 35, it is possible, above all, to check that first electrical power plug 32 has been plugged in correctly, so that an incorrect plug-in does not become noticeable only later on when a subsequent electrical power plug 32 is plugged in, for example, and/or only at the very end when flat plug 33 is plugged in. However, terminal projection 35 may also be omitted, in particular when projections 2, 3 of electrical plugs 32, 33 do not bear any coding.

Figure 10:
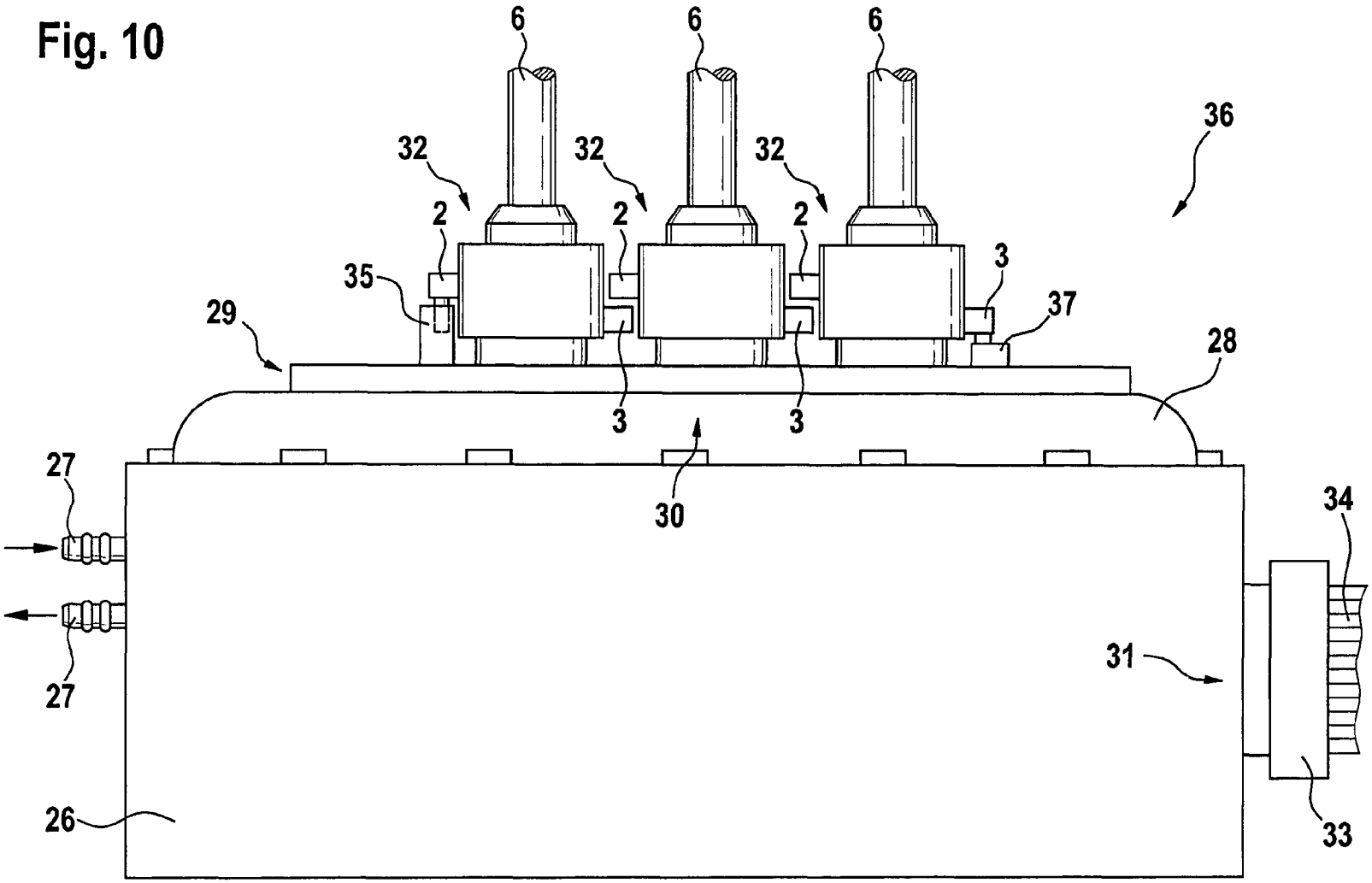
FIG. 10 shows a second exemplary embodiment of an electrical control device system having plugs mounted thereon.

FIG. 10 shows an additional electrical control device in a schematized view from the side. In terms of its basic structure, electrical control device 36 shown here is similar to electrical control device 25 shown in FIG. 9.

However, in the exemplary embodiment of electrical control device 36 shown here, electrical contact strip 29 has only one power plug region 30 on lid 28 of housing 26. Three electrical power plugs 32 are plugged into it here. Electrical power plugs 32 are provided with projections 2, 3, analogous to the exemplary embodiment shown in FIG. 9. In order to check the correct seat of electrical power plug 32 situated on the right side in FIG. 10 (and thus, via the mutual locking of projections 2, 3, also that of other electrical power plugs 32), a control switch 37 is provided on housing lid 28. If control switch 37 is pressed in the downward direction by projection 3 of right electrical power plug 32, then it is signaled to the circuit electronics of electrical control device 36 that electrical power plugs 32 are plugged into power plug region 30 correctly. The electrical voltage is enabled correspondingly.

In the exemplary embodiment of electrical control device 36 shown in FIG. 10, the supply of the electrical control signals, measuring signals etc. takes place via a flat ribbon cable 34, which is provided with a flat plug 33. Flat plug 33 is plugged into a control plug-in region 31, which in the present case is formed on the side of housing 26 of electrical control device 36. However, the position of control plug region 31 is freely selectable, such as on the front side, the rear side, and/or the underside of electrical control device 36.

As the case may be, it is also possible to dispense with control plug region 31.

What is claimed is:

1. An electrical plug device, comprising:

an elongated plug connector body having a main axis of extension;

a base element extended from the elongated plug connector body; and at least two projections projecting from a periphery of the base element in the radial direction perpendicular to the main axis of extension, wherein the at least two projections are positioned asymmetrically on the base element; and wherein each of the at least two projections has a fitting element, the fitting element configured as at least one of a projection and a recess;

wherein the at least two projections are disposed at an offset relative to each other along the main axis of extension.

2. The electrical plug device as recited in claim 1, wherein the at least two projections are disposed one of (i) at essentially diametrically opposite regions of the radial periphery of the base element, or (ii) at an angle relative to each other along the radial periphery of the base element.

3. The electrical plug device as recited in claim 1, wherein at least one of the at least two projections is configured as an anti-rotation element on the base element.

4. The electrical plug device as recited in claim 1, wherein the base element is configured as an electrical shock-hazard protector, and the at least two projections are formed as integral parts of the electrical shock-hazard protector.

5. An electrical plug device, comprising:

an elongated plug connector body having a main axis of extension;

a base element extended from the elongated plug connector body; and at least two projections projecting from a periphery of the base element in the radial direction perpendicular to the main axis of extension, wherein the at least two projections are positioned asymmetrically on the base element;

wherein each of the at least two projections has a fitting element, the fitting element configured as at least one of a projection and a recess;

wherein the at least two projections are disposed one of (i) at essentially diametrically opposite regions of the radial periphery of the base element, or (ii) at an angle relative to each other along the radial periphery of the base element;

wherein the at least two projections are disposed at an offset relative to each other along the main axis of extension; and wherein one projection has a first fitting element configured as the recess and another projection has a second fitting element configured as the projection, wherein the first and second fitting elements are at least regionally aligned along one of the radial direction or the main axis of extension.

6. A plug connection system, comprising:

a plurality of electrical sockets; and a plurality of electrical plug devices complementary to the plurality of electrical sockets;

wherein at least one electrical plug device includes:

an elongated plug connector body having a main axis of extension;

a base element extended from the elongated plug connector body; and at least two projections projecting from a periphery of the base element in the radial direction perpendicular to the main axis of extension, wherein the at least two projections are configured asymmetrically on the base element; and wherein each of the at least two projections has a fitting element, the fitting element configured as at least one of a projection and a recess;

wherein the at least two projections are disposed at an offset relative to each other along the main axis of extension.

7. The plug connection system as recited in claim 6, wherein at least two of the electrical plug devices mechanically block each other at least partially.

8. The plug connection system as recited in claim 7, further comprising:

at least one plug-in signaling device configured as one of a switch device or a signal line device.

9. The plug connection system as recited in claim 8, wherein the plug connection system is incorporated in an electrical control device system for controlling at least one electric motor in a vehicle.

* * * * *

UNITED STATES PATENT AND TRADEMARK OFFICE

CERTIFICATE OF CORRECTION

PATENT NO. : 8,647,133 B2
APPLICATION NO. : 12/998539
DATED : February 11, 2014
INVENTOR(S) : Dietmar Saur It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 234 days.

Signed and Sealed this
Twenty-ninth Day of September, 2015

Michelle K. Lee

Michelle K. Lee
*Director of the United States Patent and Trademark Office*